US011561513B2

(12) United States Patent
Delizee et al.

(10) Patent No.: US 11,561,513 B2
(45) Date of Patent: Jan. 24, 2023

(54) TIMEPIECE COMPONENT WITH A SHAFT-LIKE PORTION MADE OF NON-MAGNETIC ALLOY

(71) Applicant: Blancpain SA, Le Brassus (CH)

(72) Inventors: Alain Delizee, Les Bioux (CH); Cedric Reymond, Les Bioux (CH)

(73) Assignee: Blancpain SA, Le Brassus (CH)

( * ) Notice: Subject to any disclaimer, the term of this patent is extended or adjusted under 35 U.S.C. 154(b) by 38 days.

(21) Appl. No.: 16/439,750

(22) Filed: Jun. 13, 2019

(65) Prior Publication Data

US 2020/0019122 A1 Jan. 16, 2020

(30) Foreign Application Priority Data

Jul. 10, 2018 (EP) ..... 18182663

(51) Int. Cl.

| | |
|---|---|
| ***G04B 43/00*** | (2006.01) |
| ***C22C 5/04*** | (2006.01) |
| ***C22C 5/06*** | (2006.01) |
| ***G04B 17/06*** | (2006.01) |
| ***G04B 17/32*** | (2006.01) |
| ***G04B 19/257*** | (2006.01) |
| ***G04B 27/00*** | (2006.01) |

(52) U.S. Cl.

CPC ..... *G04B 43/007* (2013.01); *C22C 5/04* (2013.01); *C22C 5/06* (2013.01); *G04B 17/06* (2013.01); *G04B 17/32* (2013.01); *G04B 19/257* (2013.01); *G04B 27/002* (2013.01)

(58) Field of Classification Search

CPC ..... G04B 17/06; G04B 43/007; C22C 5/04; C22C 5/06

USPC ..... 428/669

See application file for complete search history.

(56) References Cited

U.S. PATENT DOCUMENTS

| | | | | |
|---|---|---|---|---|
| 2012/0112589 | A1 | 5/2012 | Marechal et al. | |
| 2014/0198624 | A1* | 7/2014 | Von Gruenigen | G04B 17/063 368/124 |
| 2015/0234361 | A1 | 8/2015 | Marechal et al. | |
| 2018/0024501 | A1* | 1/2018 | Fussinger | G04B 13/026 368/322 |
| 2018/0105902 | A1* | 4/2018 | Kazama | G01R 1/06755 |

(Continued)

FOREIGN PATENT DOCUMENTS

| | | | |
|---|---|---|---|
| CH | 712 762 | A2 | 1/2018 |
| CN | 107632507 | A | 1/2018 |
| CN | 107974570 | A | 5/2018 |

(Continued)

OTHER PUBLICATIONS

European Search Report dated Jan. 16, 2019 in European Application 1812663.7, filed on Jul. 10, 2018 (with English Translation of Categories of Documents).

(Continued)

*Primary Examiner* — Humera N. Sheikh
*Assistant Examiner* — Katherine A Christy
(74) *Attorney, Agent, or Firm* — Oblon, McClelland, Maier & Neustadt, L.L.P.

(57) ABSTRACT

A timepiece component including a shaft-like portion including at least one pivot about a pivot axis, at least the material forming this shaft-like portion is a non-magnetic alloy containing at least silver and palladium and having a Vickers hardness of more than 450 HV.

18 Claims, 1 Drawing Sheet

(56) References Cited

U.S. PATENT DOCUMENTS

2018/0112292 A1* 4/2018 Vincent ..... B21C 1/00

FOREIGN PATENT DOCUMENTS

| | | | |
|---|---|---|---|
| EP | 2 450 758 | A1 | 5/2012 |
| EP | 2 757 424 | A1 | 8/2014 |

OTHER PUBLICATIONS

Combined Chinese Office Action and Search Report dated Oct. 13, 2020 in Patent Application No. 201910620260.1 (with English translation and English translation of Category of Documents), 12 pages.

* cited by examiner

TIMEPIECE COMPONENT WITH A SHAFT-LIKE PORTION MADE OF NON-MAGNETIC ALLOY

CROSS-REFERENCE TO RELATED APPLICATION

This application claims priority to European Patent Application No. 18182663.7 filed on Jul. 10, 2018, the entire disclosure of which is hereby incorporated herein by reference.

FIELD OF THE INVENTION

The invention concerns a timepiece component comprising a shaft-like portion including at least one pivot about a pivot axis.

The invention also concerns a timepiece oscillator comprising at least one such component.

The invention also concerns a timepiece movement including at least one such oscillator and/or one at least one such component.

The invention also concerns a timepiece including at least one such movement and/or at least one such oscillator, and/or at least one such component.

The invention concerns the field of timepiece components and wheel sets, and more particularly the making of wheel sets comprised in oscillators or timepiece movements.

BACKGROUND OF THE INVENTION

It is not conventional to make non-magnetic timepiece wheel sets. However, there is a need in various types of movements which rely on the laws of magnetism, in particular, to reduce or remove friction, especially in oscillators where it is sought to obviate the conventional lever/type stop mechanisms, which are highly detrimental to the power reserve.

SUMMARY OF THE INVENTION

The invention proposes to offer an alternative to conventional timepiece wheels sets that have steel arbors, which can be used in an environment in which magnetic type mechanisms must not be disturbed.

To this end, the invention concerns a timepiece component comprising a shaft-like portion including at least one pivot about a pivot axis, according to claim 1.

The invention also concerns a timepiece oscillator comprising at least one such component.

The invention also concerns a timepiece movement including at least one such oscillator and/or one at least one such component.

The invention also concerns a timepiece including at least one such movement and/or at least one such oscillator, and/or at least one such component.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
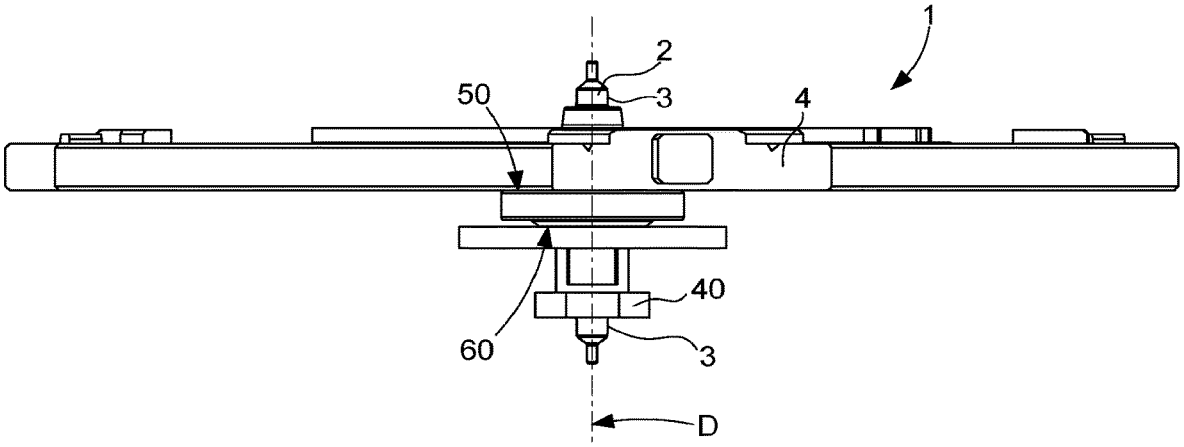
FIG. 1 represents a schematic side view of a timepiece component according to the invention, which here is a wheel set forming a balance and which includes a through shaft-like portion including two pivots at its distal ends on the axis of rotation, which shaft-like portion carries, on a first shoulder, a balance rim which is laterally supported on a first side of a collar that forms the area of largest diameter of the shaft-like portion, which also carries, on a second shoulder and supported on a second side of the collar opposite to the first, a balance plate carrying an impulse pin.
Figure 2:
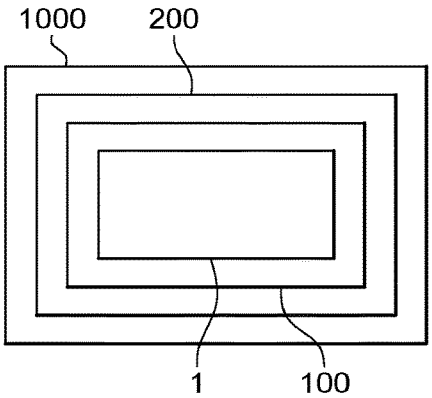
FIG. 2 is a block diagram representing a watch including a timepiece movement, which includes an oscillator that incorporates one such wheel set.

Unless otherwise specified, the compositions of the present description are mass percent compositions.

The invention concerns a timepiece component 1, notably a wheel set, which comprises a shaft-like portion 2, which includes at least one pivot 3 about a pivot axis D.

As regards the material of this shaft-like portion, it is preferable for it to have a Vickers hardness that is between that of a copper/beryllium alloy, 380 HV+/−20, and that of a 20AP steel or similar, 740 HV+/−30.

According to the invention, at least the material forming this shaft-like portion 2 is a non-magnetic alloy containing at least silver and palladium and having a Vickers hardness of more than 450 HV.

In a particular embodiment, component 1 is completely non-magnetic.

In a particular embodiment, shaft-like portion 2 runs through the entire length of component 1 in the direction of pivot axis D.

More particularly, shaft-like portion 2 carries at least one added element 4, 40, which is also non-magnetic. More particularly still, each added element 4, 40 is non-magnetic. More particularly still, the material forming each said added element 4, 40, is a non-magnetic alloy containing at least silver and palladium with a Vickers hardness of more than 450 HV.

In a particular embodiment, the material forming at least one, and more particularly each added element 4, 40, is the same as that which forms shaft-like portion 2.

In a variant, the material forming at least one added element 4, 40 is a ceramic.

In another variant, the material forming at least one added element 4, 40 is silicon and/or silicon dioxide, or a metallic glass or an amorphous or substantially amorphous metal, or suchlike, such as DLC (diamond-like-carbon) or otherwise.

In a particular composition, this non-magnetic alloy containing at least silver and palladium of shaft-like portion 2 contains, by mass, 50% to 60% palladium and 25% to 40% silver.

In another particular composition, this non-magnetic alloy containing at least silver and palladium of shaft-like portion 2 contains, by mass, 25% to 35% palladium and 65% to 75% silver, with a total by mass of at least silver and palladium less than or equal to 100%.

In another particular composition, this non-magnetic alloy containing at least silver and palladium of shaft portion 2 contains, by mass, at least 50% palladium or at least 80% silver, with a total by mass of the components of said alloy equal to 100%. The alloy can, in that case, be graded for fineness In another particular composition, this non-magnetic alloy containing at least silver and palladium, of shaft-like portion 2, is a ternary alloy containing silver, palladium and copper, and contains, by mass, 20% to 50% palladium and 20% to 50% silver, and 20% to 40% copper, with a total by mass of silver, copper and palladium less than or equal to 100%. The copper has the effect of substantially increasing the hardness of the alloy.

In an advantageous variant, this non-magnetic ternary alloy contains, by mass, 36% to 40% palladium, 38% to 42% silver, 19% to 23% copper, with a total by mass of silver, palladium and copper less than or equal to 100%. It has a Vickers hardness of between 450 HV and 510 HV, and, more particularly, between 470 HV and 490 HV. This alloy therefore forms an advantageous material for any profile-turned timepiece component, since it has good machinability and its mechanical behaviour is close to that of steel. It is therefore more particularly suitable for non-magnetic wheel sets, or at least for non-magnetic wheel set arbors.

In a particular variant, the alloy containing at least silver and palladium is free of SVHC (Substances of Very High Concern), under annex 3 of the Swiss Chemicals Ordinance on Protection against Dangerous Substances and Preparations (ChemO), and annex 1.17 of the Ordinance on Reduction of Risks from Chemical Products (ORRChim) (substances listed in Annex XIV of REACH Regulation (EC) No 1907/2006).

In a particular variant, this non-magnetic alloy containing at least silver and palladium of shaft-like portion 2 has of modulus of elasticity of between 95 GPa and 105 GPa.

In a particular variant, this non-magnetic alloy containing at least silver and palladium of shaft-like portion 2 has a coefficient of expansion of between $14.10^{-6}$ and $17.10^{-6}$.

In a particular variant, this non-magnetic alloy containing at least silver and palladium of shaft-like portion 2 has a Poisson's ratio of between 0.35 and 0.39.

In a variant, this non-magnetic alloy containing at least silver and palladium contains, by mass, 0% to 2% indium, with a total by mass of the components of said alloy equal to 100%, to reinforce the alloy.

In a variant, this non-magnetic alloy containing at least silver and palladium contains, by mass, 0% to 2% tin, with a total by mass of the components of said alloy equal to 100%, to reinforce the alloy.

In a variant, this non-magnetic alloy containing at least silver and palladium contains, by mass, 0% to 2% platinum, more particularly 0% to 0.8% platinum, and more particularly still 0% to 0.5% platinum, with a total by mass of the components of said alloy equal to 100%, In a variant only for uses inside the watch, this non-magnetic alloy containing at least silver and palladium contains, by mass, 0% to 1.0% nickel, with a total by mass of the components of said alloy equal to 100%.

In a variant, this non-magnetic alloy containing at least silver and palladium contains, by mass, 0% to 0.1% zinc, with a total by mass of the components of said alloy equal to 100%, to obtain greater strength and hardness.

In a variant, this non-magnetic alloy containing at least silver and palladium contains, by mass, 0.01% to 0.03% boron, with a total by mass of the components of said alloy equal to 100%, to obtain greater strength and hardness.

In a variant, this non-magnetic alloy containing at least silver and palladium contains, by mass, a total of less than or equal to 1% gold and/or platinum and/or ruthenium and/or rhenium, modifying agents, with a total by mass of the components of said alloy equal to 100%.

Thus, depending on the composition of the alloy, it is possible to obtain a hardness of close to 500 HV, or more than 500 HV.

In a particular case, as seen in FIG. 1, this component 1 is a balance and carries, on its shaft-like portion 2, at least one rim 4 and at least one plate 40, supported on bearing surfaces, respectively 50 and 60.

The choice of alloy makes it possible to produce a pivot-shank of very small diameter, notably less than 70 micrometres.

The invention also concerns a timepiece oscillator 100 comprising at least one such component 1.

The invention also concerns a timepiece movement 200 including at least one such oscillator 100, and/or at least one such component 1.

The invention also concerns a timepiece 1000 including at least one such movement 200, and/or at least one such oscillator 100, and/or at least one such component 1.

More particularly, this timepiece 1000 is a watch.

In short, the choice of a precious material, which may be graded for fineness, to make a timepiece wheel set arbor, goes against the prejudices related to the rapid wear of precious alloys. Choosing an alloy containing at least silver and palladium from among those described above, offers a surprising solution to the issue of wear, since these alloys show very little wear in normal conditions of use, while being non-magnetic as desired.

Naturally, although the above description mainly focused on embodiments of wheel sets with added elements, which reduces material cost, the use of these alloys containing at least silver and palladium for one-piece wheel sets is also entirely possible.

The invention provides a good solution to the still difficult problem of making non-magnetic wheel sets of small diameters, in particular for oscillator wheel sets, chronograph arbors, or otherwise.

The invention claimed is:

1. A timepiece component comprising:

a shaft portion including at least one pivot about a pivot axis, wherein at least a material forming said shaft portion is a non-magnetic alloy containing at least silver and palladium and having a Vickers hardness of more than 450 HV, wherein said shaft portion carries at least one added element which is non-magnetic, wherein said timepiece component is a balance, and the at least one added element is a rim and at least one plate, each of the rim and at least one plate is supported on respective bearing surfaces, wherein the rim is spaced apart from the plate along a longitudinal axis of the shaft, wherein a material forming each of the rim and the plate is a non-magnetic alloy containing at least silver and palladium, wherein the material forming the shaft portion has a coefficient of expansion between $14\times10^{-6}$ and $17\times10^{-6}$, wherein the material forming said shaft portion is a non-magnetic ternary alloy of silver, palladium and copper, wherein said non-magnetic ternary alloy contains, by mass, 36% to 40% palladium, 38% to 42% silver and 19% to 23% copper, the total by mass of silver, palladium and copper being less than or equal to 100%, wherein the material forming said shaft portion has a Vickers hardness of between 450 HV and 510 HV, and wherein the material forming said shaft portion has a Poisson's ratio of between 0.35 and 0.39.

2. The timepiece component according to claim 1, wherein said timepiece component is completely non-magnetic.

3. The timepiece component according to claim 1, wherein said shaft portion nuns through the entire length of said timepiece component in the direction of said pivot axis.

4. The timepiece component according to claim 1, wherein a material forming each said added element is the same as that which forms said shaft portion.

5. The timepiece component according to claim 1, wherein a material forming at least one said added element is a ceramic.

6. The timepiece component according to claim 1, wherein a material forming at least one said added element is silicon and/or silicon dioxide, or a metallic glass or an amorphous or substantially amorphous metal.

7. The timepiece component according to claim 1, wherein said non-magnetic ternary alloy has a modulus of elasticity of between 95 GPa and 105 GPa.

8. The timepiece component according to claim 1, wherein said non-magnetic ternary alloy contains, by mass, 0% to 2% indium, with a total by mass of the components of said alloy equal to 100%.

9. The timepiece component according to claim 1, wherein said non-magnetic ternary alloy contains, by mass, 0% to 2% tin, with a total by mass of the components of said alloy equal to 100%.

10. The timepiece component according to claim 1, wherein said non-magnetic ternary alloy contains, by mass, 0% to 1.0% nickel, with a total by mass of the components of said alloy equal to 100%.

11. The timepiece component according to claim 1, wherein said non-magnetic ternary alloy contains, by mass, 0% to 2% platinum, with a total by mass of the components of said alloy equal to 100%.

12. The timepiece component according to claim 1, wherein said non-magnetic ternary alloy contains, by mass, 0% to 0.1% zinc, with a total by mass of the components of said alloy equal to 100%.

13. The timepiece component according to claim 1, wherein said non-magnetic ternary alloy contains, by mass, 0.01% to 0.03% boron, with a total by mass of the components of said alloy equal to 100%.

14. The timepiece component according to claim 1, wherein said non-magnetic ternary alloy contains, by mass, a total of less than or equal to 1% of gold and/or platinum and/or ruthenium and/or rhenium, with a total by mass of the components of said alloy equal to 100%.

15. A timepiece oscillator comprising at least one timepiece component according to claim 1.

16. A timepiece movement comprising at least one oscillator according to claim 15.

17. A timepiece comprising at least one timepiece movement according to claim 16.

18. The timepiece according to claim 17, wherein the timepiece is a watch.

* * * * *